United States Patent [19]
Mouton
[11] 4,297,936
[45] Nov. 3, 1981

[54] RETRACTABLE FRET SYSTEM FOR STRINGED INSTRUMENTS

[76] Inventor: Martin J. Mouton, 619 Roseland Pkwy., Harahan, La. 70123

[21] Appl. No.: 138,715

[22] Filed: Apr. 9, 1980

[51] Int. Cl.[3] ..... G10D 3/06
[52] U.S. Cl. ..... 84/314 R
[58] Field of Search ..... 84/314 R, 314 N

[56] References Cited

U.S. PATENT DOCUMENTS

| | | | |
|---|---|---|---|
| 1,727,230 | 9/1929 | Cox | 84/314 R |
| 2,368,257 | 1/1945 | Mc Bride | 84/315 |
| 3,469,489 | 9/1969 | Barth | 84/314 R |
| 3,894,468 | 7/1975 | Dunlap | 84/314 R |

*Primary Examiner*—Lawrence R. Franklin
*Attorney, Agent, or Firm*—C. Emmett Pugh & Associates

[57] ABSTRACT

An electric bass guitar with retractable frets for the purpose of for example enabling the musician to perform dynamic slides without volume attenuation of the slide by moving the frets down into the neck of the guitar out of play. The retractable frets provide dual positions to choose from in regard to fret positions: a first, retracted position which provides frets flush with the fretboard, giving the electric bass a fretless guitar characteristic, and a second, non-retracted position which provides frets protruding out of the plane of the fretboard as in a conventional guitar; or alternatively the selection of retracting only certain desired one of the frets without interrupting the effectiveness of the remaining frets.

The neck includes on its upper side a lateral, inclined slope upon which the wedge-shaped frets ride. As the frets are moved across the neck, and ride up the slope, they rise up out from the neck body and protrude above it to be in their operative disposition. Likewise when they are moved backdown the slope, they submerge down into the neck to their inoperative disposition, resulting in effectively a fretless guitar. A tension wire, bell crank system is included in the guitar neck structure which serves to effectively "lock" the frets into their raised, operative disposition under the usual playing pressure, applied to the upper surface of the frets, but which allows the frets to be snapped back into their submerged, "fretless" disposition whenever desired during play. A longitudinally extending, flexible thumb bar is included along the length of the guitar neck to which the lower ends of the moveable frets are attached. The thumb bar has sufficient give or flexibility so that pushing pressure applied on the bar adjacent to fret will move only that fret up into its operative, raised disposition when desired during play.

6 Claims, 7 Drawing Figures

RETRACTABLE FRET SYSTEM FOR STRINGED INSTRUMENTS

BACKGROUND OF THE INVENTION

1. Field of the Invention

The invention relates to stringed instruments with frets in which at least some of the frets can be moved into and out of their operative positions during play.

2. Description of the Prior Art

Frets in general have been employed in stringed instruments, such as for example the bass guitar, to allow the musician to easily find the correct finger placement for each tone, resulting in the tone being in "tune".

Removable fret systems in general have pertained to replacement of the frets, such as in Keefer's instrument (U.S. Pat. No. 3,273,439), when they were worn or damaged; or to allow change of tonal scales as in Stoner's instrument (U.S. Pat. No. 4,132,143) such as for example changing the scale from equal tempered to just intonation.

Dunlap's instrument (U.S. Pat. No. 3,894,468) allows "slides" to be performed by the fret moving with the fingers. In this arrangement the fret is not actually movable out of play, but changes location on the neck of the instrument. Also of interest is U.S. Pat. No. 3,469,489.

The purpose of the bassist's slides on the bass is to create an enhanced musical effect, such as a crescendo, etc. Although there is available exclusively fretless basses, the musician loses the impeccability of the musical notes of a fretboard guitar. Hence the musician is more susceptible to play in between notes on the fretless "fretboard," causing him to play out of tune with the actual music.

A conventional electric bass has 20 frets on a graduated distance scale. When slides can be performed on a conventional bass, the volume of the slide is attenuated due to the presence of the protruding frets. Indeed, by the time the finger has past ten frets, the volume of the slide is reduced to about a quarter or less than the initiating note of the slide.

The present invention, as disclosed herein, provides the advantages of both types of basses, allowing slides without attenuation and regular guitar play without loss of the tonal guitar neck, and its musical characteristics. This gives the musician the capacity to choose during play between fret and fretless bass to allow the utmost musical flexibility. As a result, the invention serves in its preferred embodiment as a doubly versatile instrument for the employment of playing as an electric bass guitar.

SUMMARY OF THE DISCUSSION

The present invention provides a system of movable frets, which in the preferred embodiment are wedge-shaped and moveable in the lateral direction. The guitar neck of the preferred embodiment is constructed similar to a conventional guitar neck, but with the top of the neck cut on an incline. In the preferred embodiment, it is approximately 24 inches in length, 2.5 inches in width at the body end, and 1.75 inches at the far end.

On top of the neck are glued a series of graduated-in-width, fret infills, made preferably of extruded plastic, to be placed between the moveable frets. Underneath the fret infills is a cut out channel. A steel tension wire is run from end to end of the neck in this channel, with a tensioning screw at the end of the line. This fret hold-down wire is kept in high tension with minimal free play in the holes of the frets. At each end of the wire is a steel bell crank which pivots on an offset, center screw, thereby allowing the bell cranks to work in only one of two positions: up or down, with set screws for stops.

In the preferred embodiment, the mean length of the fret is 2.5 inches, made of steel, and on a conventional bass guitar protrudes preferrably 0.03 inches out of the fretboard. In order for the frets to retract into the fretboard, they are cut with a bottom wedge of a slope such as for example 1:8. The frets move laterally in the preferred embodiment 0.25 inches out of the board on the "E"string side of the neck, as they are held down by the wire. The ends of the frets are crimped and machined to fit into dovetail joints of a thumb bar (which can be also made of steel) which lies parallel with the neck. The bar is flexible.

With the wedged frets in the retracted position, the musician may activate the frets into their "up" position by turning the bell cranks for all of the frets, or press firmly against the thumb bar for individual frets. The thumb bar causes the wire to bend as the fret(s) protrude, and the fret(s) return to their submerged position due to the tension in the wire.

Of course, the principles of the present invention can be applied to many different string instruments besides the exemplary electrical bass guitar illustrated and discussed, and many different mechanical actuating systems or means for moving the frets vertically up into and out of their protruding dispositions (besides the inclined slope/tension wire/bell crank preferred embodiment) are possible.

DESCRIPTION OF THE DRAWINGS

For a further understanding of the nature and objects of the present invention, reference should be made to the following detailed description taken in conjunction with the accompanying drawings, in which like parts are given like reference numerals and wherein.

DESCRIPTION OF THE PREFERRED EMBODIMENT

Figure 6:
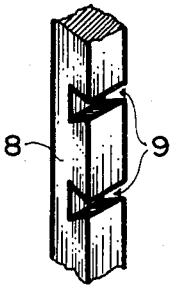
FIG. 6 is a perspective, close-up, partial view of the flexible thumb bar which controls the positioning of the frets.
Figure 7:
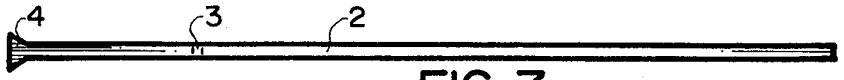
FIG. 7 is a top, close-up view of a typical fret showing its dovetailed end.
Figure 1:
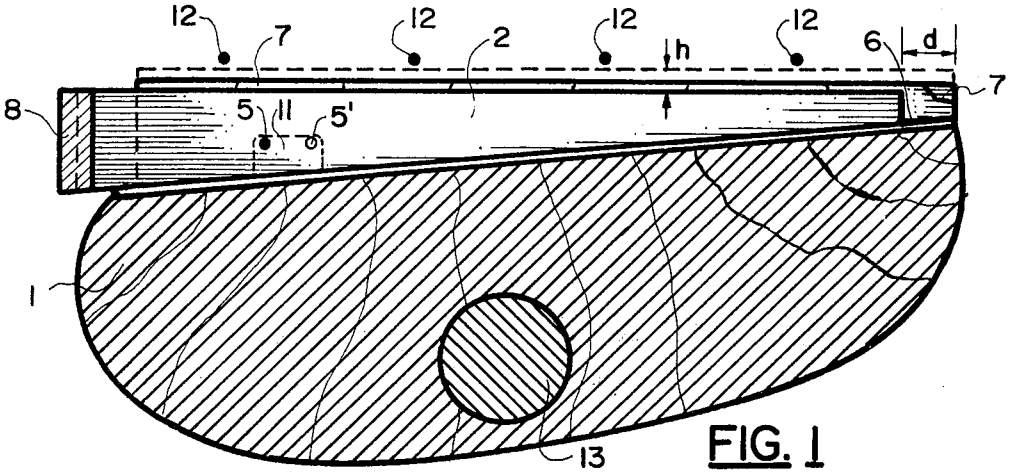
FIG. 1 is a cross-sectional, end view of the guitar neck of the preferred embodiment of the present invention.

FIG. 1 illustrates a cross-sectional view of an exemplary bass guitar with neck 1 constructed of wood, preferably, for durability and cut with a lateral incline 6 having any exemplary slope ratio of one-to-eight. A series of wedged-shaped frets 2 are also cut to slide laterally along the incline 6 between the fixed fret infills 7 (note FIG. 3). Each moveable fret 2 is drilled with a hole 3 for insertion of a fret hold-down, tension wire 5. The end of each fret 2 is constructed with a dovetail 4 which fits into the mating dovetail slots 9 of the flexible thumb bar 8 (note FIGS. 2 & 6).

The wooden guitar neck 1 allows for lateral movement of the frets 2 with movement of the fret hold-down, tension wire 5. The fret infills 7 are cut underneath to produce a rectangular cut-out forming a wire channel 11 for the wire 5 (note FIGS. 1 & 2). Fret position, either up or down, is determined by which corner the wire 5 occupies in the wire channel 11 (note FIG. 1).

The guitar strings 12 are equally spaced from each other above the frets 2; as in most guitar necks, the wooden neck 1, preferably, is drilled for and includes a steel tension rod 13 which straightens the neck if it warps due to temperature or weather changes.

Figure 2:
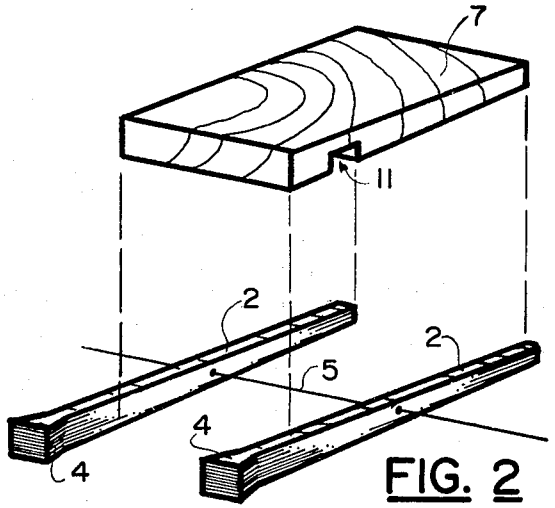
FIG. 2 is a perspective, exploded view of some of the frets of FIG. 1.

FIG. 2 is a perspective view of the frets 2 and the fret hold-down wire 5 which in a straight line connects the frets 2 through their drilled holes 3 and holds the frets under tension onto the neck 1 of the guitar. The fret infills 7 are glued to the inclined plane 6 of the guitar neck 1 between the frets 2.

As can be seen, particularly with reference to FIG. 1, the bottom sides of the frets 2 have a like sloped surface which rides on the sloped, inclined support surface 6 of the neck 1. When a fret 2 is moved laterally, inwardly (to the right in FIG. 1), either under the action of wire 5 or the thumb bar 8, it rides up the sloped surface 6 so that its upper, horizontal operative fret surface rises vertically and begins to protrude or project upwardly above the neck fret infills 7. This movement of the frets 2 continues until moving up a vertical distance "h" when it moves laterally a distance "d," putting the upper fret surface in juxtaposition to the musical strings 12 for its fret operation. By means of a bell crank system explained below, the wire 5 (when it moves to position 5') effectively locks the frets 2 into their raised, operative disposition (indicated in phantom-lines in FIG. 1), until the bell crank system is deactivated allowing the wire 5 and the frets to move back down into their inoperative "fretless," submerged disposition.

Figure 3:
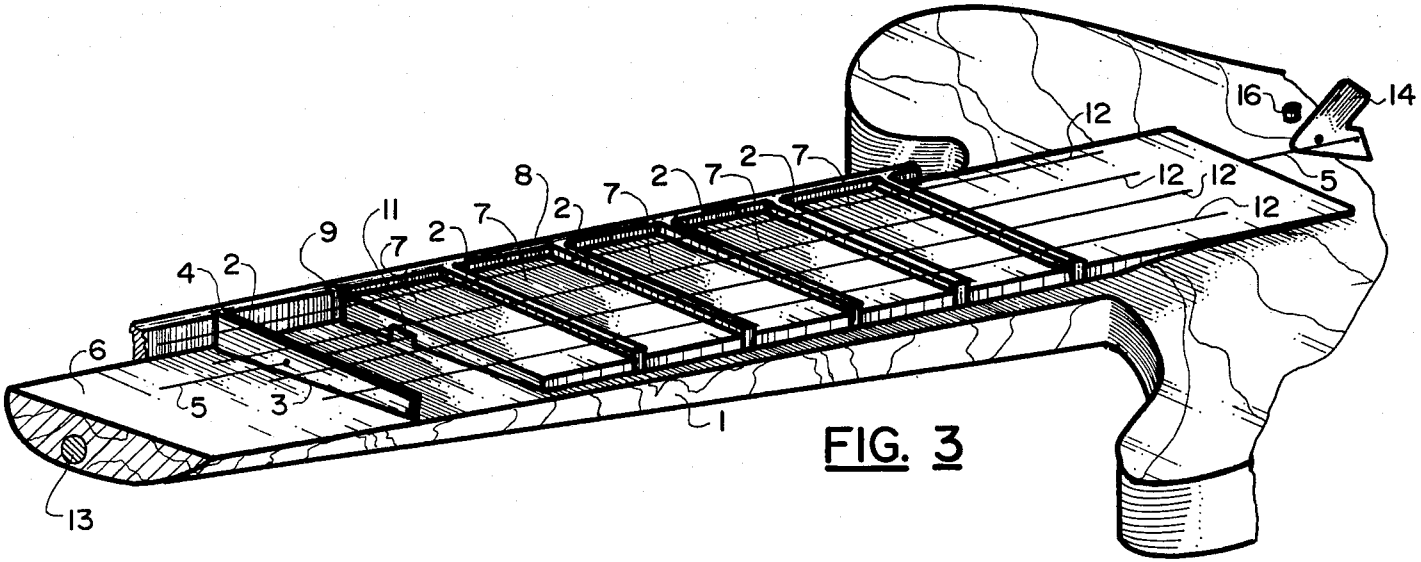
FIG. 3 is a perspective, sectional view of the guitar showing the guitar, and neck and the interval fret structure of FIG. 1.

FIG. 3 is a perspective view of the guitar depicting the guitar strings 12 on top of the frets 2 and fret infills 7. Also shown are the frets 2 as they connect their dovetail ends 4 into the mating slots 9 of the thumb bar 8, which runs parallel to the guitar neck 1 and is mounted on the guitar body and back of the tuning key board for flexibility. The thumb bar 8 is itself very flexible and plaint so that lateral pressure applied against it will tend to move it and the adjacent fret(s) 2 only in the pressure applied area, while the rest of the bar 8 and the frets 2 remain unperturbed and maintained out by the resisting pressure of the tension wire 5. This allows for selective actuation of individual ones of the frets 2. The fret infills 7 are spaced in between the frets 2 with the underneath channel 11 which allows for lateral movement of the fret hold-down, tension wire 5 under the action of a bell crank system discussed more fully below.

Figure 5:
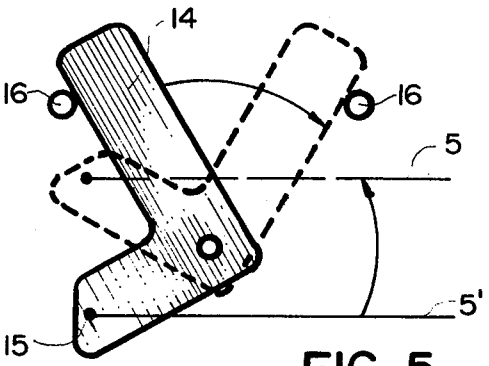
FIG. 5 is a close-up view of one element of the bell crank mechanism of FIG. 4.
Figure 4:
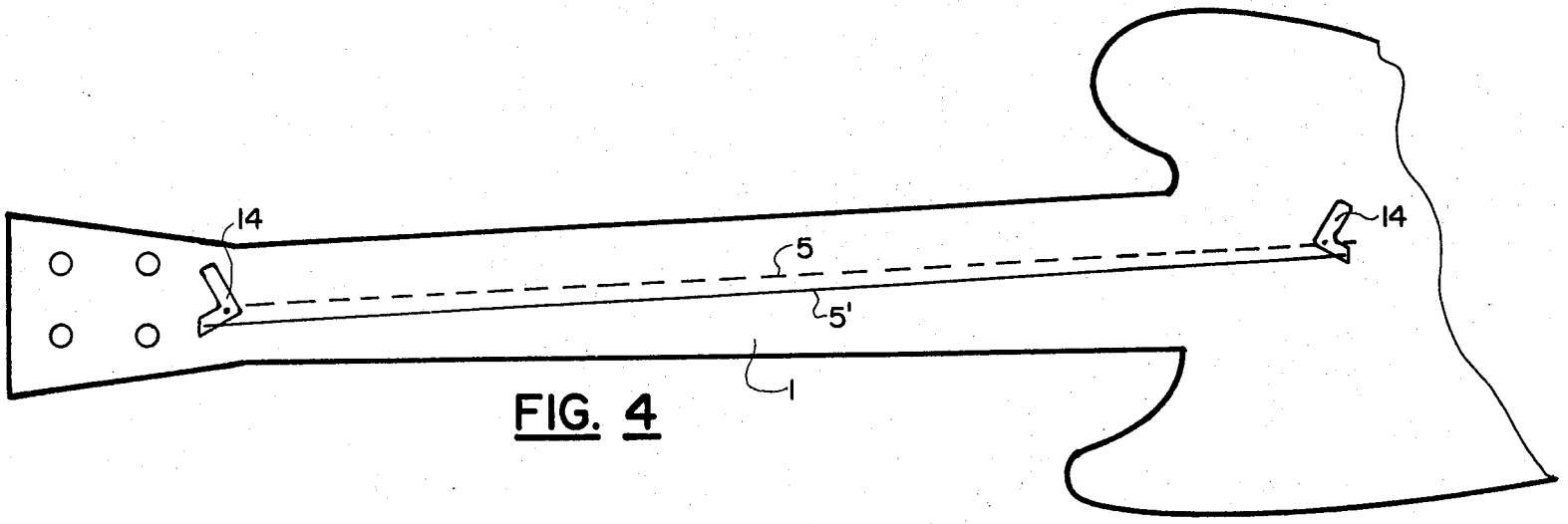
FIG. 4 is a plan, simplified view of the guitar of FIG. 3 showing its bell crank system.

FIG. 4 is a plan view of the guitar with the fret hold-down, tension wire 5 which connects the frets 2 through their holes 3 underneath the wire channels 11 of the fret infills 7, which are glued down to the inclined plane 6 of the guitar neck 1. The ends of the fret hold-down wire 5 are connected to the bell cranks 14 at point 15 (as seen in FIG. 5) located at the ends of the guitar neck 1. The bell cranks 14 are screwed into the guitar, off set of the cranks' centers. The off-set centers of the bell cranks 14 enable them to pivot in only one of two positions with no intermediates, as defined by the stops 16.

FIG. 4 shows the position of wire 5 in the fret up position, that is, the frets are protruding out of the fret infills 7. The alternate, phantom-lined position 5' is the position where the frets are flush with the fret infills 7.

Of course, the principles of the present invention can be applied to many different string instruments besides the exemplary electrical bass guitar illustrated and discussed, and many different mechanical actuating systems or means for moving the frets vertically up into and out of their protruding dispositions (besides the inclined slope/tension wire/bell crank preferred embodiment) are possible.

Because many varying and different embodiments may be made within the scope of the invention concept herein taught, and because many modifications may be made in the embodiment, herein detailed in accordance with the description requirements of the law, it is to be understood that the details herein are to be interpreted as illustrative and not in a limiting sense.

What is claimed is:

1. A stringed, musical instrument having frets, comprising:

an elongated neck having an upper surface;

a series of vibratable musical strings stretched along the length of said neck and supported above and spaced from said upper surface;

a series of laterally disposed, longitudinally spaced frets mounted on said neck and vertically moveable into and out of protruding disposition above said upper surface and in juxtaposition to said strings; and manual actuating means for moving said frets into and out of said protruding disposition during play of the instrument when so desired by the player.

2. The instrument of claim 1, wherein said actuating means comprises a mechanical system for translating laterally applied manual force to produce vertical movement of said frets.

3. The instrument of claim 2, wherein said neck includes a laterally inclined, upper supporting surface upon which said frets are supported for lateral movement across said neck, said frets including a like inclined bottom surface contacting said inclined surface; and wherein, as said frets laterally move up said inclined surface, they move up into their protruding disposition, and, as said frets move down said inclined surface, they move out of their protruding disposition.

4. The instrument of either claims 1 or 3, wherein a tension wire connected to said frets is included along the length of said neck, stretched under tension and connected at its ends to said neck, said wire holding said frets unto said neck.

5. The instrument of claim 3, wherein an elongated, flexible, longitudinally extending thumb bar is included along at least a substantial portion of the length of said neck, a number of said frets being connected at their lower ends to said thumb bar, and wherein, when said thumb bar is pushed in by the player, the fret(s) located at the point(s) of applied pressure are pushed up into protruding disposition.

6. The instrument of claim 3, wherein there is included two bell crank arms located at and attached to either end of said neck, and a tension wire connected to said frets stretched under tension between said bell cranks, said wire holding said frets unto said neck and moveable in a snapping action due to the movement, location and positioning of said bell cranks between only two set positions, a locking one when said frets are located in their protruding position and another one when said frets are located out of their protruding disposition.

* * * * *